US007350892B2

(12) United States Patent
Vinas

(10) Patent No.: US 7,350,892 B2
(45) Date of Patent: Apr. 1, 2008

(54) PRINTING SYSTEM AND METHOD OF PRINTING AN IMAGE IN A FIXED HEAD PRINTING SYSTEM

(75) Inventor: Santiago Garcia-Reyero Vinas, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 236 days.

(21) Appl. No.: 11/016,252

(22) Filed: Dec. 17, 2004

(65) Prior Publication Data

US 2006/0132517 A1 Jun. 22, 2006

(51) Int. Cl.
*B41J 29/38* (2006.01)

(52) U.S. Cl. ..... 347/14; 347/16; 347/19

(58) Field of Classification Search ..... 347/14, 347/16, 19, 42–43, 5, 9
See application file for complete search history.

(56) References Cited

U.S. PATENT DOCUMENTS 2,296,298 A 9/1942 Spalding et al.
2,342,160 A 2/1944 Muros et al.
5,589,858 A * 12/1996 Kadowaki et al. ..... 347/14
5,719,602 A 2/1998 Hackleman et al.
5,841,955 A 11/1998 Wang
5,875,028 A 2/1999 Lasken et al.
6,498,909 B1 12/2002 Reihl
6,695,424 B2 2/2004 Hakkaku et al.
6,751,424 B2 6/2004 Komatsu et al.
6,798,431 B2 9/2004 Frodl et al.
2002/0135631 A1* 9/2002 Sasaki et al. ..... 347/19

FOREIGN PATENT DOCUMENTS

EP 1 164 026 B1 10/2004

OTHER PUBLICATIONS

European Patent Office Search Report mailed Jan. 16, 2007 (6 pgs.).

* cited by examiner

*Primary Examiner*—Lam Son Nguyen
(74) *Attorney, Agent, or Firm*—Dicke, Billig & Czaja, PLLC

(57) ABSTRACT

A method of printing an image in a fixed head printer system includes sensing a medium speed of a medium traveling in proximity to a plurality of ink printheads. A maximum optical density of the printer system at the sensed medium speed is determined. The firing frequency of the plurality of ink printheads is adjusted in response to a change in medium speed such that the maximum optical density of the printer system at the sensed medium speed is not exceeded.

18 Claims, 5 Drawing Sheets

610 →

$0_b \rightarrow 000_h$
$1_b \rightarrow 7F0_h$

Fig. 6A

620 →

$0_b \rightarrow 000_h$
$1_b \rightarrow 3F0_h$
$0_b \rightarrow 7F0_h$
$1_b \rightarrow BF0_h$

Fig. 6B

630 →

$0_b \rightarrow 000_h$
$1_b \rightarrow 1F0_h$
$0_b \rightarrow 2F0_h$
$1_b \rightarrow 3F0_h$
$0_b \rightarrow 4F0_h$
$1_b \rightarrow 5F0_h$
$0_b \rightarrow 6F0_h$
$1_b \rightarrow 7F0_h$

Fig. 6C

640 →

$0_b \rightarrow 000_h$
$1_b \rightarrow 0F0_h$
$0_b \rightarrow 1F0_h$
$1_b \rightarrow 2F0_h$
$0_b \rightarrow 3F0_h$
$1_b \rightarrow 4F0_h$
$0_b \rightarrow 5F0_h$
$1_b \rightarrow 6F0_h$
$0_b \rightarrow 7F0_h$
$1_b \rightarrow 8F0_h$
$0_b \rightarrow 9F0_h$
$1_b \rightarrow AF0_h$
$0_b \rightarrow BF0_h$
$1_b \rightarrow CF0_h$
$0_b \rightarrow DF0_h$
$1_b \rightarrow EF0_h$

Fig. 6D

710 ←

$[00_h, 7E_h] \rightarrow 0_b$
$[7F_h, FF_h] \rightarrow 0_b$

Fig. 7A

720 ←

$[00_h, 3E_h] \rightarrow 00_b$
$[3F_h, 7E_h] \rightarrow 01_b$
$[7F_h, BE_h] \rightarrow 10_b$
$[BF_h, FF_h] \rightarrow 11_b$

Fig. 7B

730 ←

$[00_h, 1E_h] \rightarrow 000_b$
$[1F_h, 2E_h] \rightarrow 001_b$
$[2F_h, 3E_h] \rightarrow 010_b$
$[3F_h, 4E_h] \rightarrow 011_b$
$[4F_h, 5E_h] \rightarrow 100_b$
$[5F_h, 6E_h] \rightarrow 101_b$
$[6F_h, 7E_h] \rightarrow 110_b$
$[7F_h, FF_h] \rightarrow 111_b$

Fig. 7C

740 ←

$[00_h, 0E_h] \rightarrow 0000_b$
$[0F_h, 1E_h] \rightarrow 0001_b$
$[1F_h, 2E_h] \rightarrow 0010_b$
$[2F_h, 3E_h] \rightarrow 0011_b$
$[3F_h, 4E_h] \rightarrow 0100_b$
$[4F_h, 5E_h] \rightarrow 0101_b$
$[5F_h, 6E_h] \rightarrow 0110_b$
$[6F_h, 7E_h] \rightarrow 0111_b$
$[7F_h, 8E_h] \rightarrow 1000_b$
$[8F_h, 9E_h] \rightarrow 1001_b$
$[9F_h, AE_h] \rightarrow 1010_b$
$[AF_h, BE_h] \rightarrow 1011_b$
$[BF_h, CE_h] \rightarrow 1100_b$
$[CF_h, DE_h] \rightarrow 1101_b$
$[DF_h, EE_h] \rightarrow 1110_b$
$[EF_h, FF_h] \rightarrow 1111_b$

Fig. 7D

PRINTING SYSTEM AND METHOD OF PRINTING AN IMAGE IN A FIXED HEAD PRINTING SYSTEM

BACKGROUND

A conventional inkjet printing system includes a printhead, an ink supply which supplies liquid ink to the printhead, and an electric controller which controls the printhead. The printhead ejects ink drops through a plurality of orifices or nozzles toward a print medium, such as a sheet or web of paper, so as to print onto the print medium. Typically, the nozzles are arranged in one or more arrays such that properly sequenced ejection of ink from the nozzles causes characters or the images to be printed upon the print medium as the print medium is moved relative to the printhead.

In one arrangement, commonly referred to as a fixed head printing system, one or more printheads are fixed or held stationary relative to the print medium as the print medium is advanced during printing. Depending on the printer system, one or more individual printheads can be included. If a plurality of individual printheads are utilized, the printheads are normally arranged in a staggered configuration to form a printhead array which spans a nominal page width of the print medium. In a fixed head system, the print medium, such as a continuous web of material or a cut sheet paper supply, is moving under the nozzles of the one or more printheads that remain fixed to the paper path.

In some fixed head printing system, depending on desired image resolution and system constraints, a user can print some images at a given print medium speed and some images at either higher or print medium speeds using a print medium speed controller in the print medium path. If the user selects a lower speed, the optical density or resolution of the printed image does not change, even if system constraints allow the plurality of nozzles of the printhead to fire more ink to achieve a better image resolution. Conversely, if the user selects a print medium speed faster than the system can accommodate at a chosen image resolution, the printer system stops firing ink, thereby stopping the printing in order to maintain the integrity of the nozzles of the printhead.

SUMMARY

One aspect of the present invention provides a method of printing an image in a fixed head printer system. The method includes sensing a medium speed of a medium traveling in proximity to a plurality of ink printheads. A maximum optical density of the printer system at the sensed medium speed is determined. The firing frequency of the plurality of ink printheads is adjusted in response to a change in medium speed such that the maximum optical density of the printer system at the sensed medium speed is not exceeded.

Another aspect of the present invention provides a fixed head inkjet printing system. The printing system includes a fixed printhead assembly including at least one individual printhead, where each printhead includes a plurality of nozzles. A medium speed sensor is adapted to sense a speed of the medium moving adjacent to the printing system. A controller is associated with the fixed printhead assembly and the medium speed sensor and configured to determine a maximum optical density of the printed system at the sensed speed of the medium. The controller is also configured to adjust the firing frequency of the plurality of nozzles such that the maximum optical density of the printing system at the sensed medium speed is not exceeded.

BRIEF DESCRIPTION OF THE DRAWINGS

FIG. 6A-6D are tables illustrating converting binary data to hexadecimal data according to the present invention.

FIGS. 7A-7D are tables illustrating converting hexadecimal data to binary data according to the present invention.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

Figure 1:
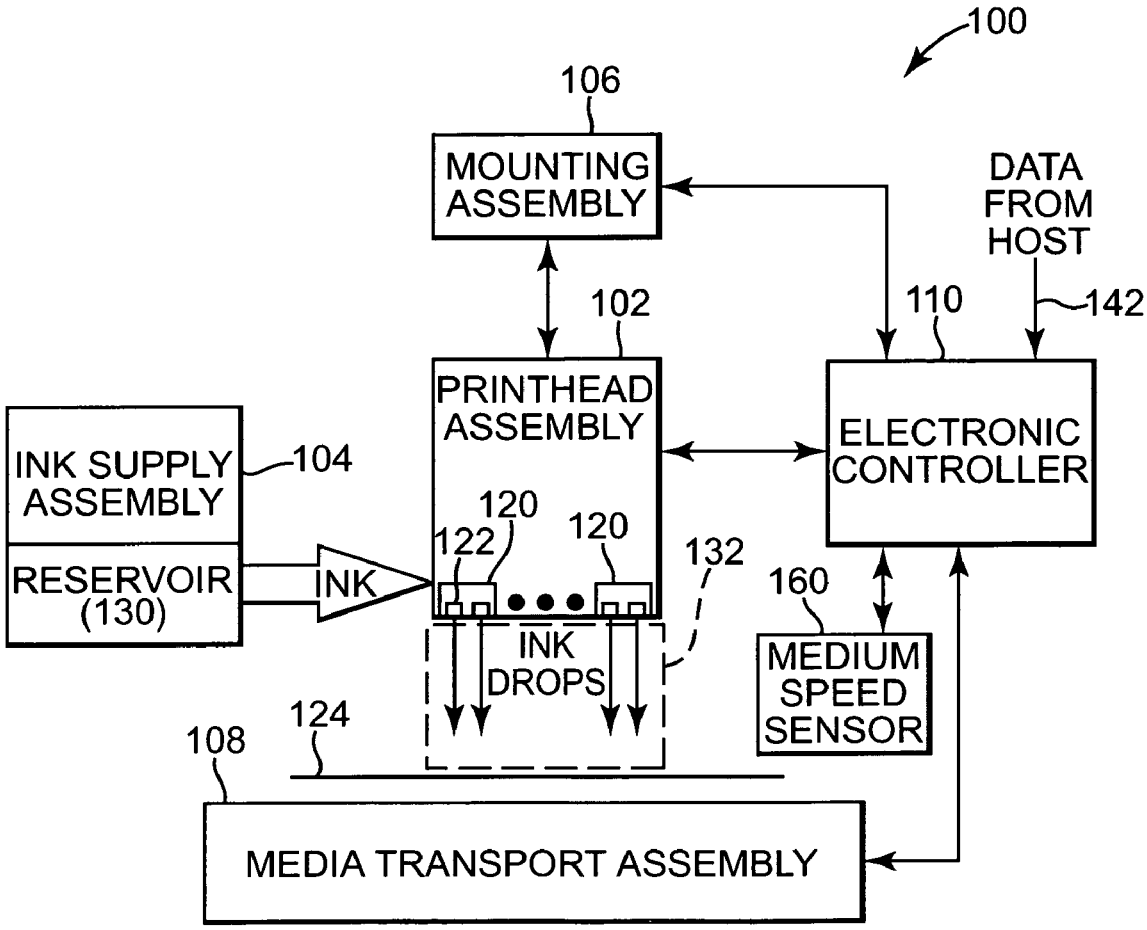
FIG. 1 is a block diagram illustrating one embodiment of an inkjet printing system according to the present invention.

FIG. 1 illustrates one embodiment of an inkjet printing system 100 according the present invention. Inkjet printing system 100 includes inkjet printhead assembly 102, inkjet supply assembly 104, mounting assembly 106, media transport assembly 108, and electronic controller 110. Inkjet printing system 100 is a fixed head system. Mounting assembly 106 secures inkjet printing system 100, and more specifically printhead assembly 102, at a fixed or stable environment, in proximity to media transport assembly 108 and print medium 124. Inkjet printhead assembly 102 is formed according to an embodiment of the present invention and includes a plurality of printheads 120 which eject drops of ink through a plurality of nozzles or orifices 122 and toward print medium 124 so as to print onto print medium 124. Print medium 124 is any type of suitable sheet material, such as paper, cardstock, transparencies, Mylar®, or any other material capable of absorbing ink. Typically, nozzles 122 are arranged in one or more columns or arrays such that properly sequenced ejection of ink from nozzles 122 causes characteristics, symbols, and/or other graphics or images to be printed upon print medium 124 as print medium 124 passes in proximity to or under inkjet printhead assembly 102. In one embodiment, each of printheads 120 is capable of printing or firing dots or drops of ink one inch wide via the plurality of nozzles 122.

Ink supply assembly 104 supplies ink to printhead assembly 102 and includes reservoir 130 for storing ink. As such, ink flows from reservoir 130 to inkjet printhead assembly 102. In one embodiment, inkjet printhead assembly 102 and ink supply assembly 104 are housed together in an inkjet cartridge or pen. In another embodiment, ink supply assembly 104 is separated from inkjet printhead assembly 102 and supplies ink to inkjet printhead assembly 102 through an interface connection, such as a supply tube.

As previously discussed, mounting assembly 106 secures inkjet printhead assembly 102 relative to media transport assembly 108. Media transport assembly 108 positions print medium 124 relative to inkjet printhead assembly 102. Thus, print zone 132 is defined adjacent to nozzles 122 in an area between inkjet printhead assembly 102 and print medium 124. Thus, media transport assembly 108 advances print medium 124 relative to inkjet printhead assembly 102, which is fixed.

Electronic controller 110 communicates with inkjet printhead assembly 102, media transport assembly 108, and mounting assembly 106. Electronic controller 110 receives data 142 from a host system, such as a computer, and includes memory for temporarily storing data 142. Typically, data 142 is sent to inkjet printing system 100 via an electronic, infrared, optical, or other information transfer path. Data 142 represents, for example, an image, a document, and/or a file to be printed. As such, data 142 forms a print job for inkjet printing system 100 and includes one or more print job commands and/or command parameters.

In one embodiment, electronic controller 110 provides control of inkjet printhead assembly 102 including timing control for ejection of ink dots or drops from nozzles 122. As such, electronic controller 110 operates on data 142 to define a pattern of ejected ink dots or drops which form characters, symbols, and/or other graphics or images on print medium 124. Timing control, and therefore, the pattern of ejected ink dots or drops is determined by the print job commands and/or command parameters. In one embodiment, logic and drive circuitry forming a portion of electronic controller 110 is located on inkjet printhead assembly 102. In another embodiment, logic and drive circuitry is located off inkjet printhead assembly 102.

Inkjet printing system 100 includes medium speed sensor 160 which senses a medium speed of print medium 124 traveling under, or in close proximity to, printhead assembly 102 via media transport assembly 108. In one embodiment, medium speed sensor 160 is associated with media transport assembly 108. For example, medium speed sensor 160 can be associated with a roller or other component of media transport assembly 108 which rotates or moves as print medium 124 advances or moves past inkjet print system 100. In another embodiment, medium speed 160 can be associated with other components of printing system 100, or can be a separate, independent component capable of sensing the medium speed of print medium 124. In one embodiment, medium speed sensor 160 is configured to continuously sense a speed of print medium 124 moving adjacent to or below print system 100.

Electronic controller 110 is associated with printhead assembly 102 and medium speed sensor 160 and is configured to determine a maximum optical density of printing system 100 at the speed of print medium 124 as sensed by medium speed sensor 160. Electronic controller 110 is also configured to adjust the firing frequency of the plurality of nozzles 122 within printheads 120 such that the maximum optical density of printing system 100 is not exceeded. In one embodiment, electronic controller 110 is configured to adjust the firing frequency of the plurality of nozzles 122 such that the maximum optical density of printing system 100 is achieved. Electronic controller 110 can also be configured to determine a maximum number of dots or drops of ink per inch that can be supplied via nozzles 122 to print medium 124 at the speed of print medium 124, as sensed by medium speed sensor 160. Likewise, electronic controller 110 can be configured to adjust the firing frequency of the plurality of nozzles 122 such that a maximum number of drops or dots of ink per inch that can be supplied to print medium 124 at the speed sensed by medium speed sensor 160 is not exceeded.

Figure 2:
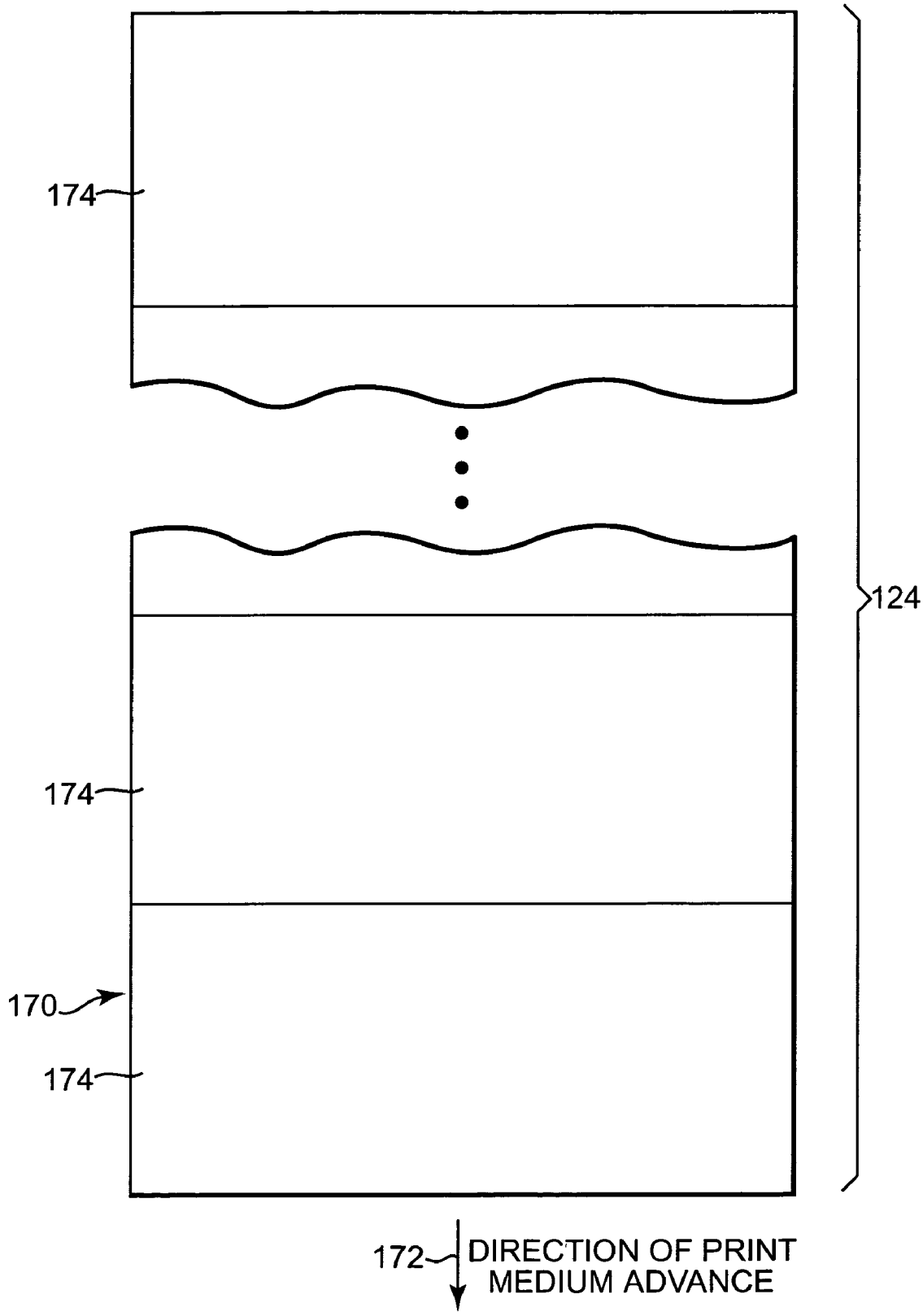
FIG. 2 is a schematic illustration of portions of a continuous web print medium according to the present invention.

As illustrated in FIG. 2, print medium 124 is a continuous form or continuous web print medium 124. As such, print medium 124 includes a plurality of continuous print medium portions 170. Print medium portions 170 represent, for example, individual sheets, pages, forms, or the like, which may be physically separated from each other by cutting or by tearing along, for example, perforated lines. In one embodiment, continuous web print medium 124 can represent numerous pages or sheets of print medium which require repetitively printing identical information including text and pictures; such as in the case of printing a page or sheet of a newspaper, magazine, or book. In these instances, printing system 100 undergoes a repetitive process corresponding to each page or sheet of continuous web print medium 124. Since inkjet printhead assembly 102 is fixed, print medium 124 moves relative to inkjet printhead assembly 102 during printing. More specifically, print medium 124 is advanced relative to inkjet printhead assembly 102 in a direction indicated by arrow 172.

In operation, print medium 124 is supplied to printing system 100 from another location or system or apparatus which can be assisting in the printing process or printing other aspects of a print job. Likewise, once print medium 124 leaves printing system 100, it travels to another location in which a system or apparatus may be operating upon it. The speed of print medium 124 traveling under, or in proximity to, printing system 100 may be controlled at locations other than printing system 100 (i.e., up or down stream of printing system 100). For example, printing system 100 may be one of a plurality of apparatuses or systems used in an overall printing scheme. In these circumstances, the speed of print medium 124 is determined due to a variety of circumstances, one of which may be the text or images being printed by printing system 100.

In conventional printing systems, if a print medium speed is slowed or lowered, the optical resolution or density of the text or image being printed by a printing system does not change to increase the optical resolution, even if nozzles of printheads are capable of firing more ink at the selected speed. Conversely, if a print medium speed is increased or sped up such that nozzles of printheads are incapable of firing at a frequency to maintain desired optical resolution or density due to electrical constraints of the system, the printing system can shut down, thereby stopping the firing of nozzles in order to prevent damage to nozzles or printheads.

Figure 3:
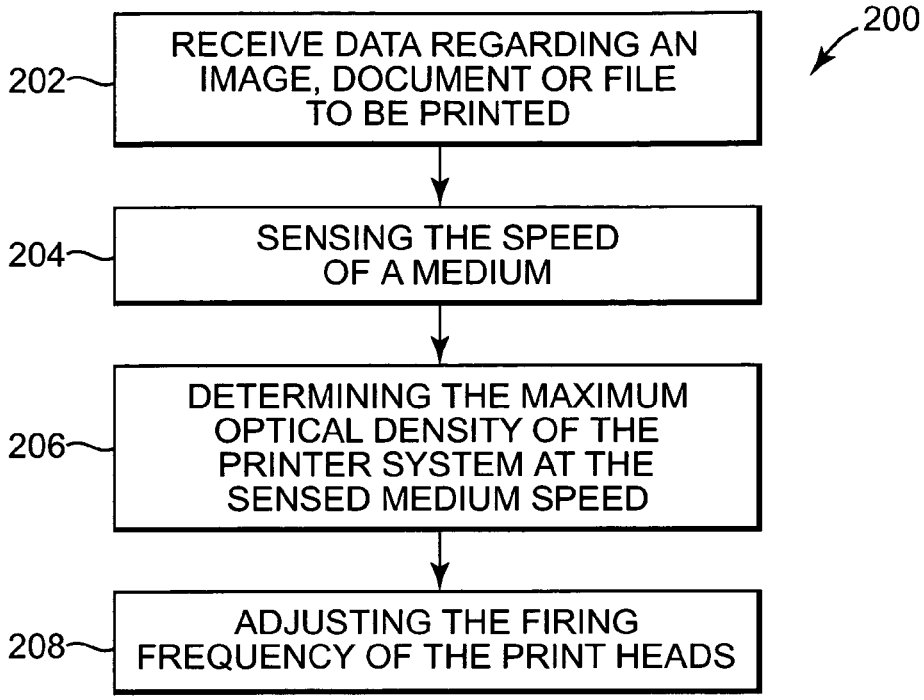
FIG. 3 is a flow chart illustrating a method of printing an image in a fixed head printing system according to the present invention.

FIG. 3 is a flow chart illustrating method 200 of printing an image in a fixed head printing system in accordance with the present invention. At step 202, data regarding an image, document, file, or the like to be printed is received. As previously discussed, electronic controller 110 can receive data 142 from a host system. At step 204, medium speed sensor 160 senses the speed of print medium 124 traveling in proximity to or beneath printing system 100. At step 206, electronic controller 100 determines the maximum optical density of printer system 100 at the sensed medium speed of print medium 124. Printing systems, such as printing system 100, have a maximum optical density based upon the maximum firing frequency of nozzles 122 of printheads 120.

In one embodiment, for example, nozzles 122 can fire at a rate of 36 kilohertz, indicating that up to 36 million dots or drops of ink can be ejected per second. Therefore, electronic controller 110 can determine the maximum optical density of printing system 100 since both the maximum firing frequency of printing system 100 and the speed of print medium 124 are known.

For example, in one embodiment, if the maximum firing frequency of printing system 100 is 36 kilohertz, and print medium 124 is traveling at a rate of speed of 30 inches per second (IPS), then the maximum optical density results in 1,200 dots per inch (DPI) since 36 kilohertz divided by 30 IPS equates to 1,200 DPI. In another embodiment, with printing system 100 having a maximum firing capacity of 36 kilohertz and a sensed print medium speed of 240 IPS, the maximum optical density of printer system 100 equates to 150 DPI (36 kilohertz divided by 240 IPS equates to 150 DPI). It is understood by those in the art that the specific numbers utilized herein are for example purposes only, and that the maximum optical density of any printing system can be determined once the maximum firing frequency of the system and the speed of the print medium is known.

At step 208, electronic controller 110 adjusts the firing frequency of printheads 120 and nozzles 122 such that the maximum optical density of printing system 100 at a given speed is achieved, or at least not exceeded.

Figure 4:
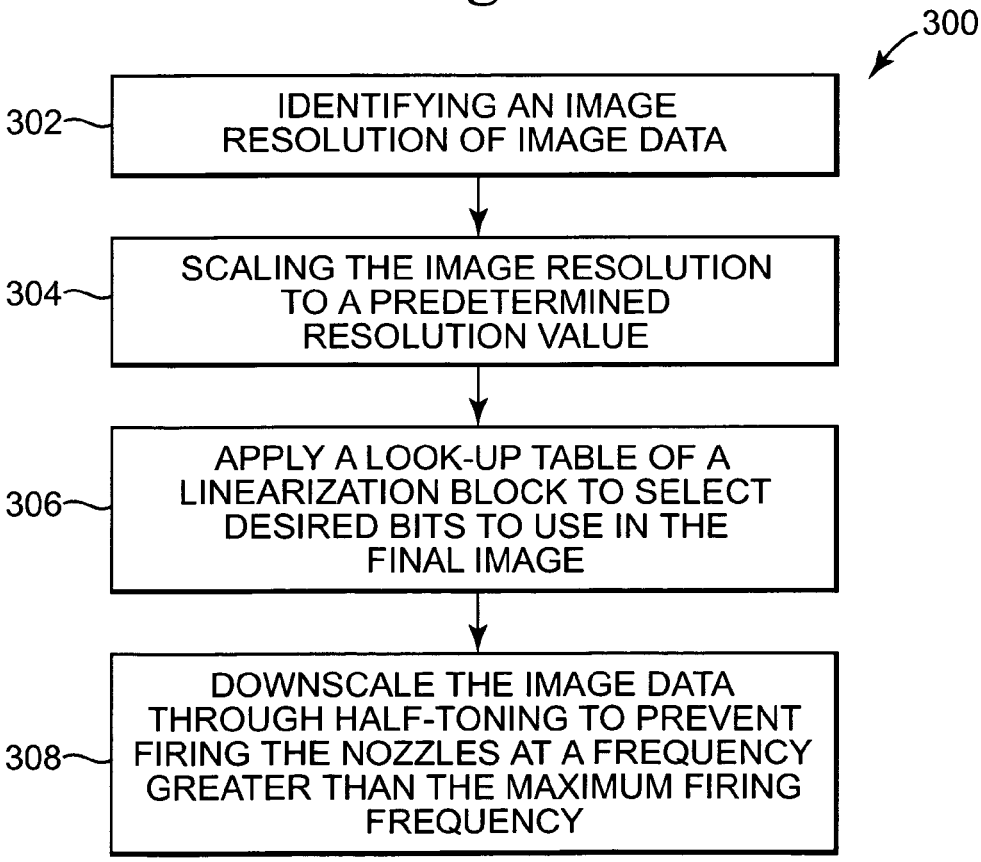
FIG. 4 is a flow chart illustrating a method of determining the maximum optical density of a printing system according to the present invention.

FIG. 4 is a flow chart illustrating one embodiment of method 300 for determining the maximum optical density of printer system 100 at a sensed medium speed. In one embodiment, method 300 is accomplished by controller 110 or by the best system. At step 302, a predefined or predetermined image resolution of image data 142 is identified. This image resolution is the requested image resolution of the image to be printed. At step 304, the image resolution is scaled to a predetermined resolution value. In one embodiment, the input resolution is scaled to 1,200 DPI, however, it is understood that any predetermined resolution value may be utilized. At step 306, a look-up table of a linearization block is applied to select desired bits of data to use in the final image. In one embodiment, the look-up table is a 256-entry look-up Tables 610, 620, 630, and 640, respectively, which includes 8-bits of input and 12-bits of output. FIGS. 6A-6D are four separate examples of a look-up table which converts 8-bit binary data into 12-bit hexadecimal data.

In the example of a scaled image resolution to 1,200 DPI, Table 610 of FIG. 6A represents a look-up table for scaling the image resolution to 150 DPI. In this example, all bytes where the least significant bit is a binary "0" goes to 000 in hexadecimal, and all bytes where the least significant bit is "1" in binary goes to 7F0 in hexadecimal. In another embodiment, for printing at a resolution of 300 DPI, look-up Table 620 of FIG. 6B is utilized. In this example, all bytes where the least significant bit is a binary 0 and the fifth least significant bit is a binary 0 goes to 000 in hexadecimal. Similarly, all bytes where the least significant bit is a binary 1 and the fifth least significant bit is a binary 0 goes to 3F0 in hexadecimal. Similar conversions are shown where the least significant binary bit is 0 and the fifth least significant binary bit is 1 goes to 7F0 in hexadecimal and where the least significant binary bit is 1 and the fifth least significant binary bit is 1 goes to BF0 in hexadecimal.

Tables 630 and 640 of FIGS. 6C and 6D utilize similar patterns of converting binary data to hexadecimal data for printing image resolutions of 450 DPI and 600 DPI, respectively. Table 630 of FIG. 6C utilizes the least significant binary bit, the fourth least significant binary bit, and the seventh least significant binary bit. FIG. 6D utilizes the first, third, fifth, and seventh least significant binary bits. It is understood, however, that various significant binary bits can be used when converting binary data to hexadecimal data without deviating from the present invention. In addition, it is understood that specific binary bits may be selected for conversion based upon past recognized patterns or observations.

At step 308 of FIG. 4, the selected desired bits of data are downscaled through half-toning to prevent firing nozzles 122 of printheads 120 at a frequency greater than the maximum firing frequency of printing system 100. Thus, selected pixels are printed based upon selected converted binary bits to hexadecimal bits.

FIGS. 7A-7D represent Tables 710, 720, 730, and 740, which reduces the 8-bit linearized values to 1, 2, 3, or 4 hifipe bits. Tables 710, 720, 730, and 740 shown in FIGS. 7A-7D, respectively, are used to scale the image data within the maximum optical density of printing system 100. Table 710 of FIG. 7A is used, in the example previously discussed, to select specific pixels to be printed at 150 DPI at 1-bit per pixel (BPP). Any hexadecimal value between 00 and 7E is converted to binary 0 and any data between hexadecimal value 7F and FF are converted to a binary 1. Similarly, Table 720 of FIG. 7B is used for converting the 1,200 DPI to 300 DPI at 2 BPP, wherein a hexadecimal value between 00 and 3E is converted to binary 00, hexadecimal value between 3F and 7E is converted to binary 01, hexadecimal value between 7F and BE is converted to binary 10 and hexadecimal value between BF and FF is converted to binary 11. A similar pattern is used in Tables 730 and 740 of FIGS. 7C and 7D, representing scaling the image from 1,200 DPI to 450 DPI at 3 BPP and 600 DPI at 4 BPP, respectively. It is understood that converting specific hexadecimal values to specific binary values in FIGS. 7A-7D as a method of choosing specific pixels to be printed are done for illustrative purposes only. Other conversion methods may be used without varying from the present invention.

Figure 5:
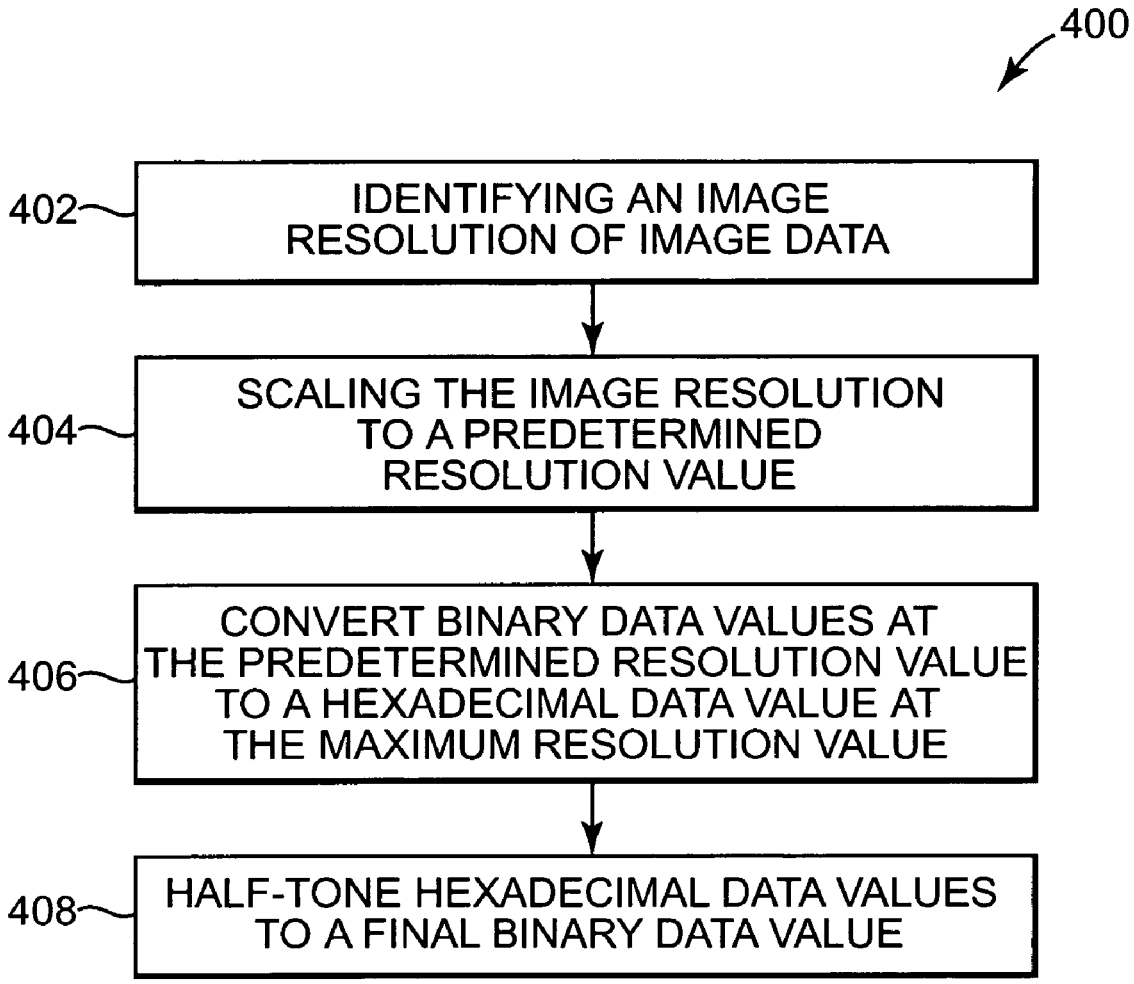
FIG. 5 is a flow chart illustrating another method of determining the maximum optical density of the printer system according to the present invention.

FIG. 5 is a flow chart illustrating method 400 for determining the maximum optical density of printer system 100 at a sensed medium speed. In one embodiment, method 300 is accomplished by controller 110 or by the host system. At step 402, an image resolution of image data 142 is identified. At step 404, the image resolution is scaled to a predetermined resolution value. At step 406, binary data values at the predetermined resolution value are converted to a hexadecimal data value at the maximum resolution value, as shown with reference to FIGS. 6A-6D. At step 408, hexadecimal data values are half-toned to a final binary data value, as shown with reference to FIGS. 7A-7D, thereby identifying the specific pixels to be printed.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A method of printing an image in a fixed head printing system, the method comprising:

receiving desired image resolution data regarding the image;

sensing a medium speed of a medium traveling in proximity to at least one ink printhead;

determining a maximum optical density of the printing system at the sensed medium speed; and adjusting the firing frequency of the at least one ink printheads in response to a change in medium speed such that the firing frequency of the at least one ink printheads equates to a firing frequency resulting in the image being printed at the desired image resolution when the maximum optical density of the printer system is not exceeded, and such that the firing frequency of the at least one ink printheads equates to a maximum firing frequency of the at least one ink printheads when the maximum optical density of the printer system is exceeded.

2. The method of claim 1, wherein sensing a paper medium further comprises:

continuously sensing a medium speed of the medium traveling in proximity to the at least one of ink printheads.

3. The method of claim 1, wherein adjusting the firing frequency of the at least one ink printheads further comprises:

adjusting the firing frequency of a plurality of nozzles of each ink printhead.

4. The method of claim 1, wherein adjusting the firing frequency of the at least one ink printheads further comprises:

adjusting the firing frequency of the at least one ink printheads such that a maximum image resolution of the printer system is not exceeded at the sensed medium speed.

5. The method of claim 4, wherein adjusting the firing frequency of the at least one ink printheads further comprises:

adjusting the firing frequency of the at least one ink printheads such that a maximum image resolution of the printer system is achieved at the sensed medium speed.

6. The method of claim 1, wherein determining a maximum optical density of the printer system at the sensed medium speed further comprises:

utilizing ASIC information within the fixed head printer system in determining a maximum optical density at the sensed medium speed.

7. The method of claim 1, wherein determining a maximum optical density of the printer system at the sensed medium speed further comprises:

identifying an image resolution of image data representing the image;

scaling the image resolution of the image data to a predetermined resolution value;

utilizing a linearization block to apply a entry look-up table to the image data to select desired bits to use in the final image which will maximize the firing frequency of the plurality of printhead based upon the sensed medium speed; and half-toning the desired bits to downscale the image data, such that a maximum firing frequency of the at least one printhead at the sensed medium speed is not exceeded.

8. The method of claim 1, wherein determining a maximum optical density of the printer system at the sensed medium speed further comprises:

identifying an image resolution of image data representing the image;

scaling the image resolution of the image data to a predetermined resolution value;

converting each binary data value of the image data at the predetermined resolution value to a hexadecimal data value at a maximum resolution value based upon the sensed medium speed; and half-toning each hexadecimal data value to a final binary data value, such that a maximum firing frequency of the at least one printheads at the sensed medium speed is not exceeded.

9. The method of claim 1, wherein determining a maximum optical density of the printer system at the sensed medium speed further comprises:

determining a maximum number of dots of ink per inch that can be supplied to the medium at the sensed medium speed.

10. The method of claim 9, wherein adjusting the firing frequency of the plurality of ink printheads further comprises:

adjusting the firing frequency of the at least one ink printheads such that the maximum number of dots of ink per inch that can be supplied to the medium is not exceeded.

11. A fixed head inkjet printing system comprising:

a fixed printhead assembly including at last one individual printhead, each printhead including a plurality of nozzles;

a medium speed sensor adapted to sense a speed of the medium moving adjacent to the printing system; and a controller associated with the fixed printhead assembly and the medium speed sensor, the controller configured to receive desired image resolution data regarding the image and determine a maximum optical density of the printing system, and further configured to adjust the firing frequency of the plurality of nozzles in response to a change in medium speed such that the firing frequency of the at least one ink printheads equates to a firing frequency resulting in the image being printed at the desired image resolution when the maximum optical density of the printer system is not exceeded, and such that the firing frequency of the at least one ink printheads equates to a maximum firing frequency of the at least one ink printheads when the maximum optical density of the printer system is exceeded.

12. The fixed head inkjet printing system of claim 11, wherein the medium speed sensor is configured to continuously sense a speed of the medium moving adjacent to the printing system.

13. The fixed head inkjet printing system of claim 11, wherein the controller is configured to determine a maximum number of dots of ink per inch that can be supplied to the medium at the sensed speed of the medium.

14. The fixed head inkjet printing system of claim 13, wherein the controller is configured to adjust the firing frequency of the plurality of nozzles such that the maximum number of dots of ink per inch that can be supplied to the medium is not exceeded.

15. The fixed head inkjet printing system of claim 13, wherein the central processing unit is configured to identify an image resolution of image data representing the image, scale the image resolution of the image data to a predetermined resolution value, convert each binary data value of the image data at the predetermined resolution value to a hexadecimal data value at a maximum resolution value based upon the sensed medium speed, and half-tone each hexadecimal data value to a final binary data value, such that a maximum firing frequency of the at least one printheads at the sensed medium speed is not exceeded.

16. The fixed head inkjet printing system of claim 11, wherein the controller is configured to identify an image resolution of image data representing the image, scale the image resolution of the image data to a predetermined resolution value, utilize a linearization block to apply a entry look-up table to the image data to select desired bits to use in the final image which will maximize the firing frequency of the plurality of printhead based upon the sensed medium speed, end half-tone the desired bits to downscale the image data, such that a maximum firing frequency of the at least one printhead at the sensed medium speed is not exceeded.

17. A fixed head inkjet printing system comprising:

means for receiving desired image resolution data regarding the image;

means for sensing a medium speed of a medium traveling in proximity to at least one ink printhead;

means for determining a maximum optical density of the printing system of the sensed medium speed; and means for adjusting the firing frequency of the at least one ink printheads in response to a change in medium speed such that the firing frequency of the at least one ink printheads equates to a firing frequency resulting in the image being printed at the desired image resolution when the maximum optical density of the printer system is not exceeded, and such that the firing frequency of the at least one ink printheads equates to a maximum firing frequency of the at least one ink printheads when the maximum optical density of the printer system is exceeded.

18. A method of printing an image in a fixed head printing system, the method comprising:

receiving desired image resolution data regarding the image;

identifying a medium speed of a medium traveling under a plurality of individual print heads;

determining a maximum optical density of the printing system at the sensed medium speed; and altering the firing frequency of the plurality of printheads in response to a change in the medium speed such that the firing frequency of the at least one ink printheads equates to a firing frequency resulting in the image being printed at the desired image resolution when the maximum optical density of the printer system is not exceeded, and such that the firing frequency of the at least one ink printheads equates to a maximum firing frequency of the at least one ink printheads when the maximum optical density of the printer system is exceeded.

* * * * *

UNITED STATES PATENT AND TRADEMARK OFFICE

CERTIFICATE OF CORRECTION

PATENT NO. : 7,350,892 B2
APPLICATION NO. : 11/016252
DATED : April 1, 2008
INVENTOR(S) : Santiago Garcia-Reyero Vinas It is certified that error appears in the above-identified patent and that said Letters Patent is hereby corrected as shown below:

In column 9, line 11, in Claim 16, delete “end” and insert -- and --, therefor.

Signed and Sealed this

Fifth Day of August, 2008

JON W. DUDAS
*Director of the United States Patent and Trademark Office*